US009187921B1

(12) United States Patent
Neighbors

(10) Patent No.: US 9,187,921 B1
(45) Date of Patent: Nov. 17, 2015

(54) ELEVATED WATER TANK

(71) Applicant: TANK CONNECTION, L.L.C., Parsons, KS (US)

(72) Inventor: William E. Neighbors, Parsons, KS (US)

(73) Assignee: Tank Connection, L.L.C., Parsons, KS (US)

( * ) Notice: Subject to any disclaimer, the term of this patent is extended or adjusted under 35 U.S.C. 154(b) by 0 days.

(21) Appl. No.: 14/570,629

(22) Filed: Dec. 15, 2014

(51) Int. Cl.

| | |
|---|---|
| ***E04B 2/40*** | (2006.01) |
| ***E04H 12/30*** | (2006.01) |
| ***E04H 4/00*** | (2006.01) |
| *E04H 12/34* | (2006.01) |

(52) U.S. Cl.
CPC ..... *E04H 12/30* (2013.01); *E04H 4/0043* (2013.01); *E04H 4/0062* (2013.01); *E04H 12/342* (2013.01)

(58) Field of Classification Search
CPC ..... E04H 4/0043; E04H 4/0062; E04H 4/108; E04H 12/342; E04H 4/0093; E04B 1/34315; E04B 1/34321; E04B 2001/2484; E04B 2/40; E04B 2001/0061; E04B 2001/3276; E04B 2/90
USPC ..... 52/245, 249, 745.05, 745.13, 79.2, 52/169.7, 169.13, 169.5
See application file for complete search history.

(56) References Cited

U.S. PATENT DOCUMENTS

| | | | | | |
|---|---|---|---|---|---|
| 3,524,780 | A * | 8/1970 | Clements | 156/191 |
| 4,089,139 | A * | 5/1978 | Moffa et al. | 52/20 |
| 4,112,644 | A * | 9/1978 | Allen | 52/245 |
| 4,338,752 | A * | 7/1982 | Stanelle | 52/194 |
| 4,513,550 | A * | 4/1985 | Kotcharian | 52/745.01 |
| 4,519,415 | A * | 5/1985 | Carn | 137/318 |
| 4,616,465 | A * | 10/1986 | Byers et al. | 52/745.01 |
| 5,038,540 | A * | 8/1991 | Krautz | 52/245 |
| 5,271,193 | A * | 12/1993 | Olsen et al. | 52/19 |
| 5,383,311 | A * | 1/1995 | Strickland | 52/20 |
| 5,608,998 | A * | 3/1997 | Hume | 52/245 |
| 5,791,107 | A * | 8/1998 | Danisch et al. | 52/249 |
| 6,032,421 | A * | 3/2000 | Yamada | 52/79.8 |
| 6,715,243 | B1 * | 4/2004 | Fons | 52/192 |
| 8,256,174 | B2 * | 9/2012 | Irniger et al. | 52/245 |
| 2003/0024176 | A1 * | 2/2003 | Kanechika et al. | 52/169.7 |
| 2004/0134144 | A1 * | 7/2004 | Morrison et al. | 52/245 |
| 2010/0126084 | A1 * | 5/2010 | Sill | 52/127.3 |
| 2010/0154318 | A1 * | 6/2010 | Shockley et al. | 52/82 |

* cited by examiner

*Primary Examiner* — Phi A
(74) *Attorney, Agent, or Firm* — Hovey Williams LLP

(57) ABSTRACT

An elevated tank broadly comprises an outer wall, a tank ceiling, a tank floor, an internal support structure, and a fluid infrastructure. The outer wall is formed of a number of panels connected together in layers. The tank floor is elevated above the ground and is enclosed within the outer wall. An upper portion of the outer wall, the ceiling, and the tank floor cooperatively form a tank chamber for holding a fluid or other substance. A lower portion of the outer wall forms a lower chamber underneath the tank floor. The elevated tank is constructed by connecting a layer of panels together and jacking or lifting them up, then bolting another layer of panels together underneath the previously connected layer of panels, and continuing building the elevated tank from the top down.

11 Claims, 8 Drawing Sheets

ELEVATED WATER TANK

BACKGROUND

The present invention relates to elevated tanks.

Elevated tanks are used for holding a fluid such as water and other substances above the ground so that the fluid can be gravity fed as needed. Conventional elevated tanks are often built on a concrete pedestal or similar structure and often have a tank chamber that must be raised above the pedestal. This requires workers to work at dangerous heights and in dangerous conditions. This also requires the use of particularly skilled workers, which further increases the cost of constructing the elevated tank. Conventional elevated tanks also often include tank floors that extend beyond an outer wall of the tank, further complicating tank construction and increasing the cost of constructing the tank.

SUMMARY

The present invention solves the above-described problems and provides a distinct advance in the art of elevated tanks. More particularly, the present invention provides an elevated tank for holding a fluid such as water or other substance. The elevated tank can be constructed from the top down and includes a number of panels that makes transporting and constructing the tank easier.

The elevated tank broadly includes an outer wall, a ceiling, a tank floor, an internal support structure, and a fluid infrastructure. The outer wall may include a number of panels forming layers constructed from the top down. The ceiling may include a number of panels formed over a top of the outer wall. The tank floor may be elevated above the ground and enclosed within the outer wall. The tank floor may be at least partially formed of a number of panels. The internal support structure may include a number of vertical members connected to the outer wall under the tank floor for reinforcing the outer wall and preventing the outer wall from buckling under the weight of the fluid in the tank. The fluid infrastructure distributes the fluid to and from the tank and includes a number of pipes, valves, pumps, and other components. The tank floor, ceiling, and an upper portion of the outer wall form a tank chamber for holding the fluid therein. A lower portion of the outer wall forms a lower chamber for protecting the fluid infrastructure, for storing service implements and other devices, and for providing access to the tank floor and upper chamber.

The elevated tank may be constructed by connecting panels of a first layer of the outer wall, elevating the first layer, and connecting panels of a second layer of the outer wall below the first layer. The first and second layers are connected together and then elevated for sequentially forming additional layers below the first and second layers in this same manner. The tank floor is constructed by connecting panels of the tank floor together and connecting the tank floor to one or more of the layers of the outer wall. The tank floor and previously constructed layers of the outer wall are then elevated for forming additional layers below the tank floor.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
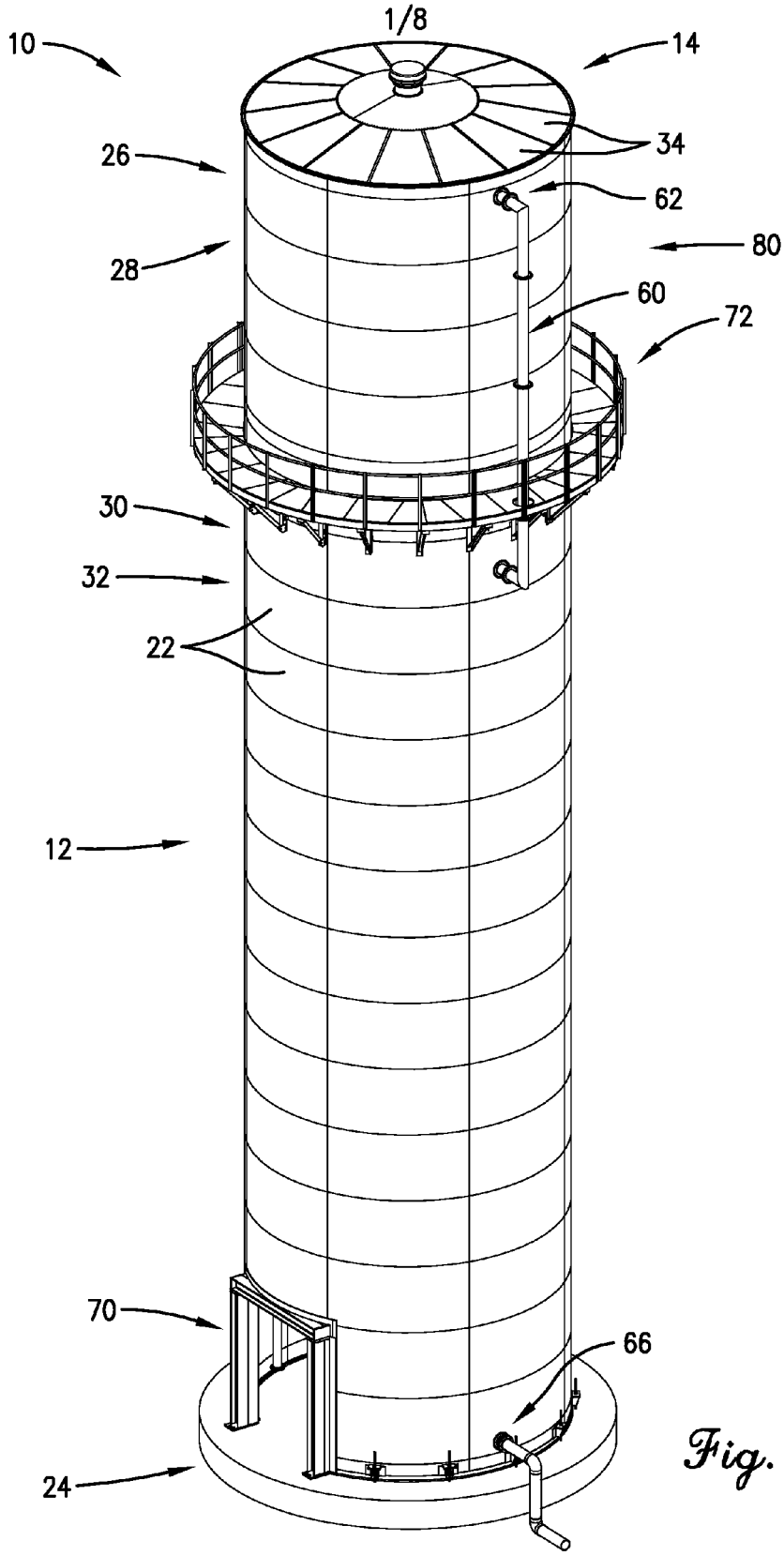
FIG. 1 is a perspective view of an elevated tank constructed in accordance with an embodiment of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Turning now to the drawing figures, an elevated tank 10 constructed in accordance with an embodiment of the invention is illustrated. The elevated tank 10 broadly comprises an outer wall 12, a ceiling 14, a tank floor 16, an internal support structure 18, and a fluid infrastructure 20.

The outer wall 12 encloses the tank floor 16, internal support structure 18, and at least a portion of the fluid infrastructure 20, and includes a number of panels 22. The outer wall 12 is supported on a base 24 formed of concrete, steel, or any other suitable material. The base 24 may be a pre-existing or specially constructed structure. In one embodiment, the base 24 is a circular concrete pad.

The panels 22 may be rolled tapered panels (RTP) and may be aluminum, steel or any other suitable material. The panels 22 may be bolted or otherwise connected together and may be covered in a coating such as reinforced epoxy powder-coating or a baked-on coating. In one embodiment the coating is LIQ Fusion 7000 FBE™. The panels 22 may be painted any color and may be painted with a logo or any other design. The panels 22 are arranged and constructed in layers such as first and second layers 26, 28 and first and second lower layers 30, 32 as described below.

The ceiling 14 covers the top of the elevated tank 10 and may be formed of aluminum, steel, or any other suitable material. The ceiling 14 extends radially beyond the outer wall 12 and may be dome shaped, cone shaped, or any other concave shape for shedding rainwater and adding structural rigidity. The ceiling 14 may be covered in a coating such as LIQ Fusion 7000 FBE™ coating or other baked-on coating and may be painted any color. The ceiling 14 may include a number of panels 34 overlapping and/or bolted together.

The tank floor 16 supports fluid in the elevated tank 10 above the ground and includes a bar grate 36, a sub floor 38, a tank pad 40, a number of floor panels 42, an aperture 44, and a number of outer reinforcements 46, as best shown in FIGS. 3-8.

The bar grate 36 extends along a top of the internal support structure 18 and distributes forces from the tank floor 16 to the internal support structure 18. The bar grate 36 may be formed of aluminum, steel, or any other suitable material and may be bolted to the internal support structure 18.

The sub floor 38 covers the bar grate 36 and is a layer of plastic or other suitable material. The sub floor 38 is placed over the bar grate 36 and separates the tank pad 40 from the sub floor 38.

The tank pad 40 covers the sub floor 38 and cushions the floor panels 42 on the bar grate 36 and sub floor 38. The tank pad 40 may be an asphalt impregnated cane fiber pad placed between the floor panels 42 and the sub floor 38. In one embodiment the tank pad 40 is approximately 0.5 inches thick.

The floor panels 42 cover the tank pad 40 and may be formed of aluminum, steel, or any other material. The floor panels 42 may be 10 gauge, 12 gauge, or similar material thickness and are placed over the tank pad 40, bolted together, and sealed with caulking or other suitable water tight sealant. Some of the floor panels 42 may extend over the outer reinforcements 46.

The aperture 44 extends through the tank floor 16 for connecting a pipe of the fluid infrastructure 20 to the tank chamber (described below) and pumping water into or draining water out of the tank chamber. The aperture 44 may be a round hole or similar shape and extends through the bar grate 36, the sub floor 38, the tank pad 40, and the floor panels 42 via a number of openings 48. Thus, the bar grate 36, the sub floor 38, the tank pad 40, and the floor panels 42 are similarly oriented with their openings 48 aligned with each other to form the aperture 44.

The outer reinforcements 46 connect the tank floor 16 to one or more layers of the outer wall 12 and may include angle irons, C-channels, I-beams, or other structural members. Some of the outer reinforcements 46 may be connected above the tank pad 40 while other outer reinforcements may be connected below the bar grate 36.

The tank floor 16, an upper portion of the outer wall 12, and the ceiling 14 cooperatively form a tank chamber 50 for holding a fluid or other substance. The tank chamber 50 may be watertight (via caulking or other watertight material) to hold water or may be sufficiently sealed to hold grain or any other desired substance. The tank chamber 50 may have a capacity of approximately fifty thousand gallons to approximately one million gallons. Smaller and larger capacities also may be constructed.

The tank floor 16, a lower portion of the outer wall 12, and the base 24 cooperatively form a lower chamber 52 below the tank chamber 50 for storing service equipment and for protecting the fluid infrastructure 20 described below. The lower chamber 52 and the lower portion of the elevated tank 10 below the tank chamber 50 may be approximately 10 feet to approximately 150 feet in height. Shorter or taller lower portions may be constructed. An access ladder, stairs or other man-way structures may be installed in the lower chamber 52 for accessing the bottom of the tank floor 16. A man-way door may be installed just below the tank floor 16 in the lower chamber 52 for access to an outer man-way structure described below.

The internal support structure 18 supports the tank floor 16 and fluid or other substance being held in the tank chamber 50 and includes a number of vertical members 54 and horizontal beams 56. The vertical members 54 may be formed of aluminum, steel, or any other suitable material and may be C-channels, I-beams, rectangular or square tubing, or any other suitably shaped member. The vertical members 54 may be connected vertically end-to-end and connected to some of the panels 22 of the outer wall 12. The vertical members 54 form a load path for directing the forces and stress from the weight of the substance being held in the tank chamber 50 to upper layers of the outer wall 12. The vertical members 54 spread the forces and stress to several layers of the outer wall 12 so as to prevent the panels of the outer wall 12 from buckling. The horizontal beams 56 may be formed of aluminum, steel, or any other suitable material and may be C-channels, I-beams, rectangular or square tubing, or any other suitably shaped member. The horizontal beams 56 are positioned on top of the vertical members 54 and distribute forces from the tank floor 16 to the vertical members 54.

The fluid infrastructure 20 extends below the tank chamber 50 and to the ground and may include pipes such as a primary distribution pipe 58 and an overflow pipe 60, pumps, valves, gauges, and other fluid distribution components. The primary distribution pipe 58 connects to the tank chamber 50 via one or more apertures in the tank floor 16 (described below) and may extend downward through a lower chamber (described below) to the ground. The overflow pipe 60 drains water exceeding a predetermined level in the tank and may extend from the tank 10 via an upper aperture 62 extending through the outer wall 12 just below the ceiling 14, downward along an outside of the outer wall 12, into the lower chamber via a middle aperture 64 extending through the outer wall 12 just below the tank floor 16, down through the lower chamber, and to the outside via a lower aperture 66 extending through the outer wall 12 just above the ground (FIG. 1).

Figure 2:
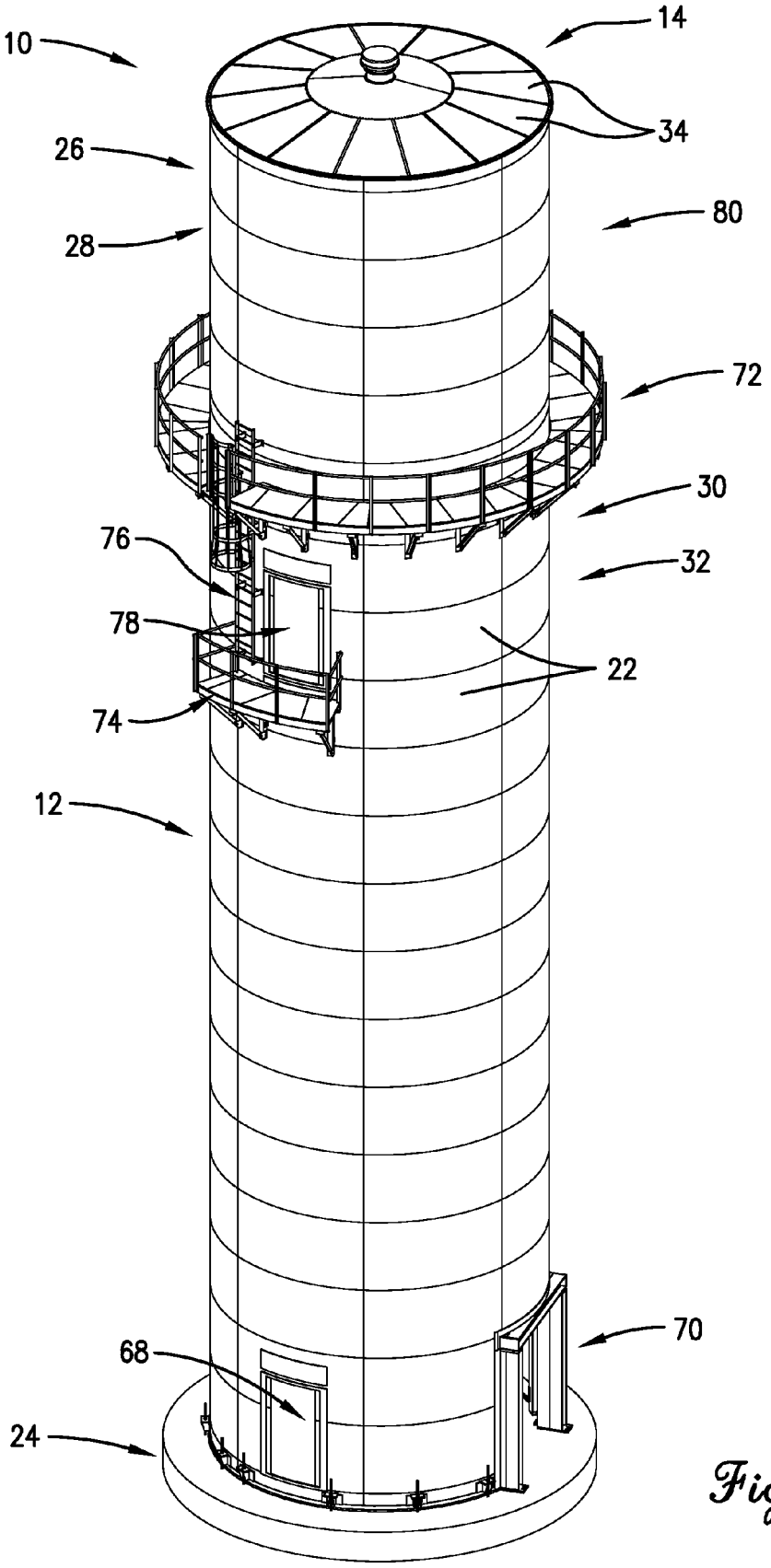
FIG. 2 is another perspective view of the elevated tank of FIG. 1.
Figure 3:
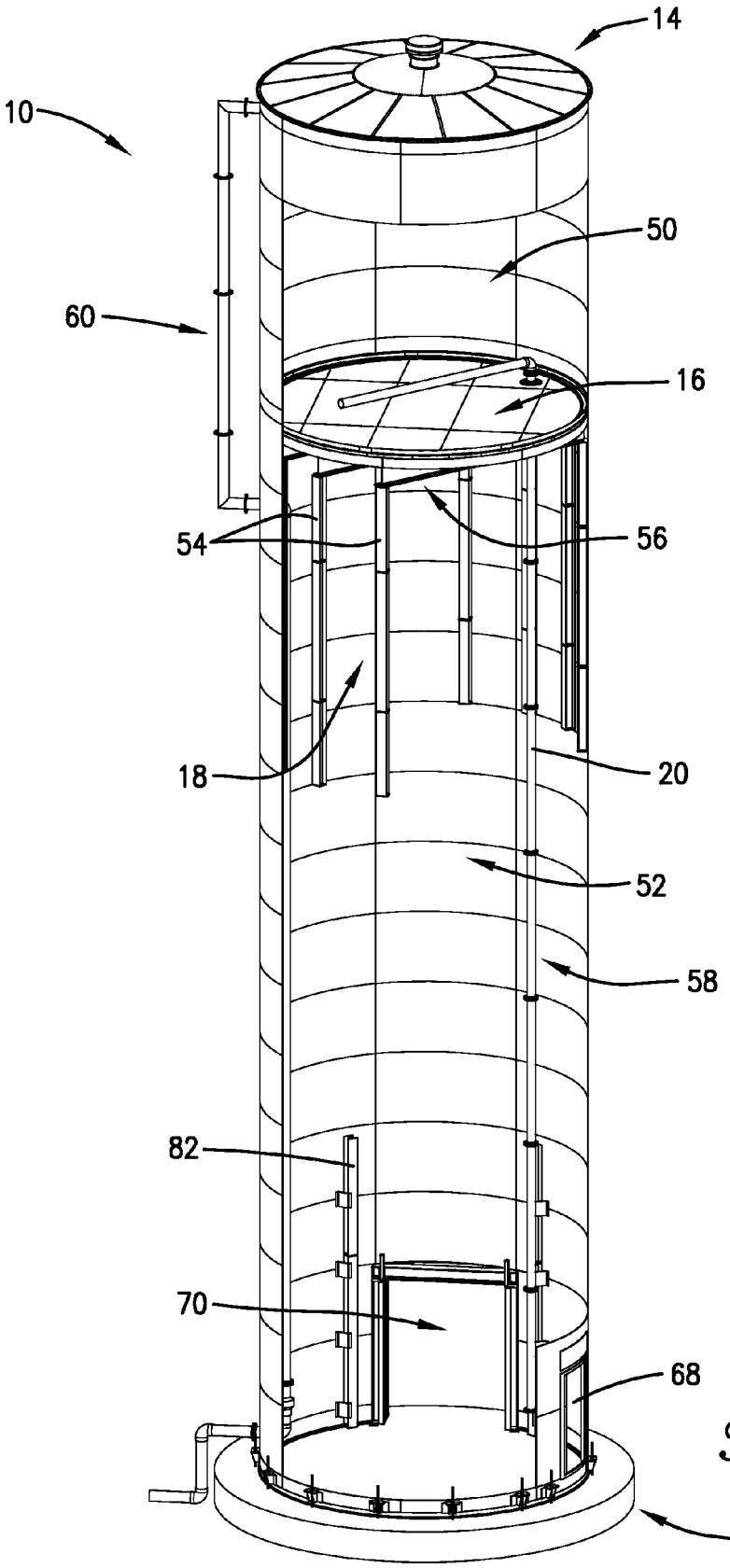
FIG. 3 is a cutaway perspective view the elevated tank of FIG. 1.
Figure 4:
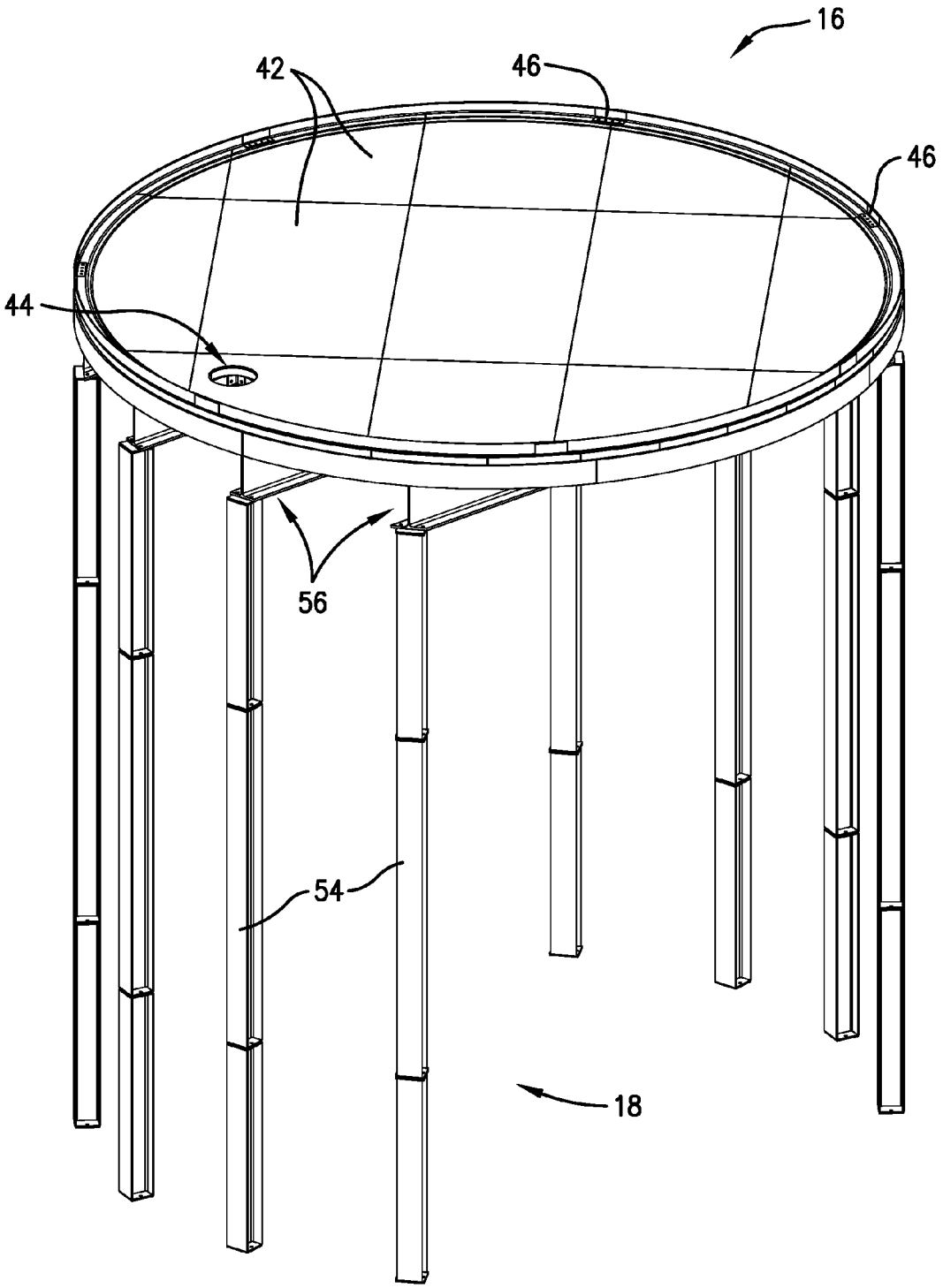
FIG. 4 is an enlarged top perspective view of a tank floor and an internal support structure of the elevated tank of FIG. 1.
Figure 5:
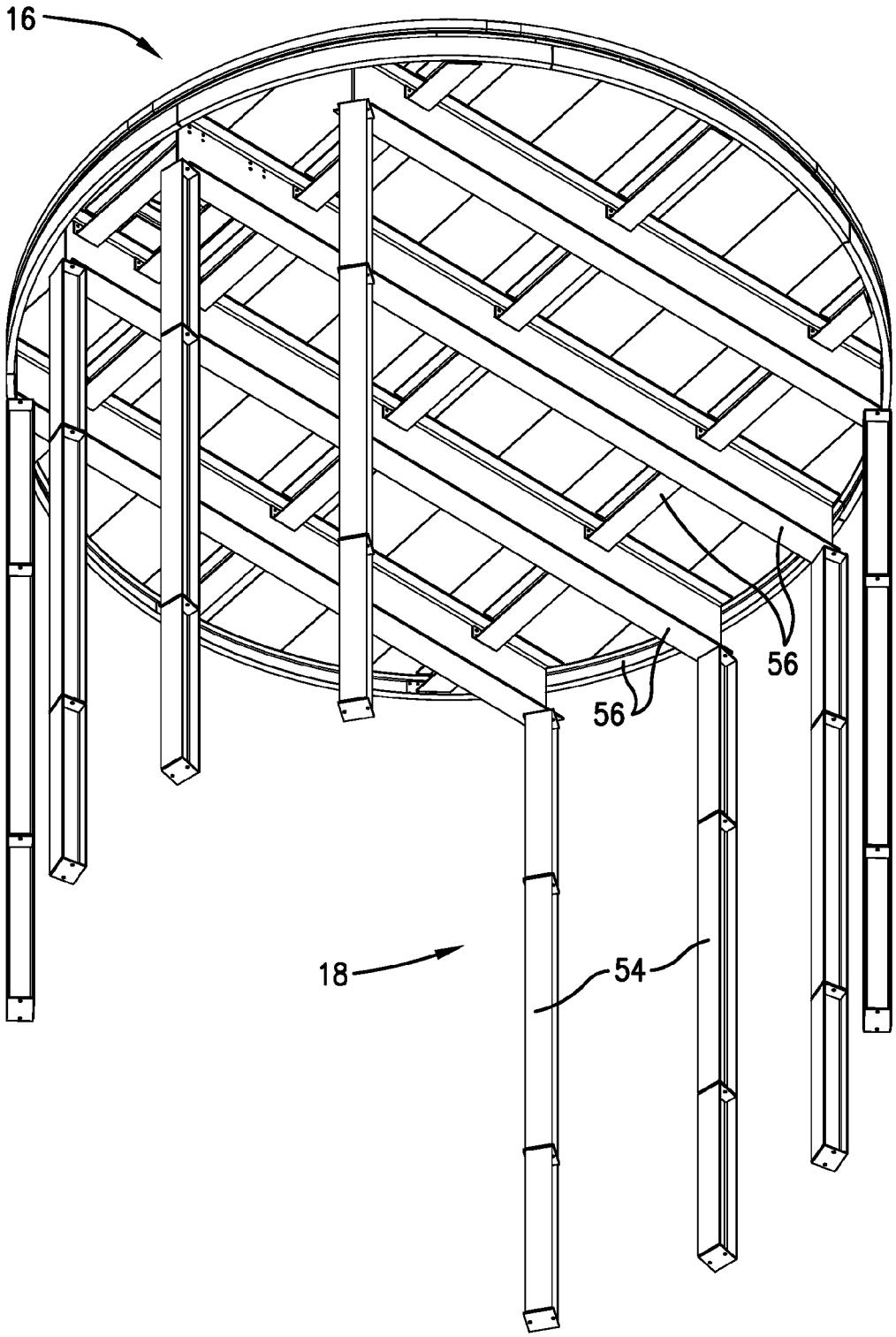
FIG. 5 is a bottom perspective view of the tank floor and internal support structure of FIG. 4.
Figure 6:
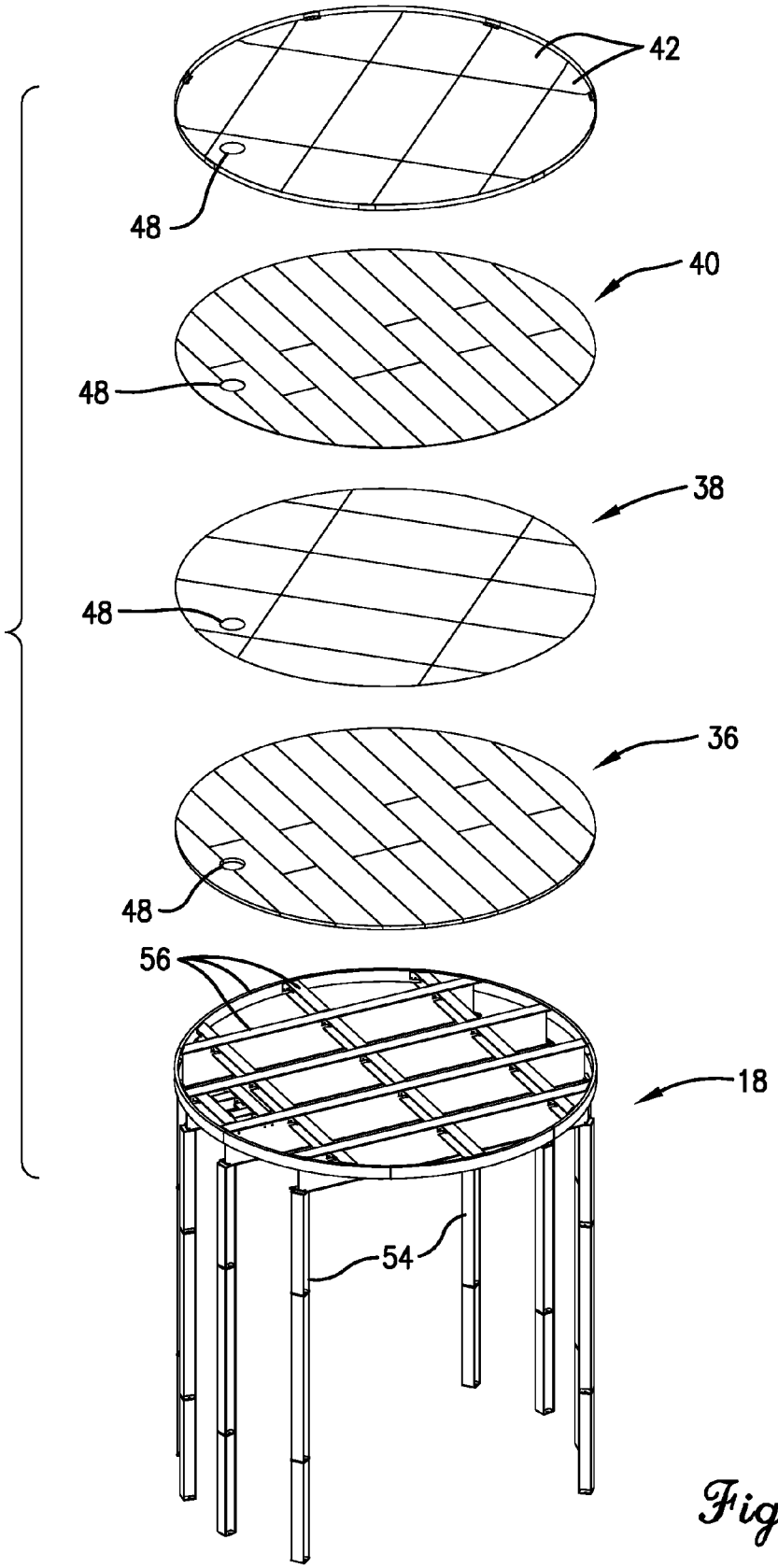
FIG. 6 is an exploded view of the tank floor of FIG. 4.
Figure 7:
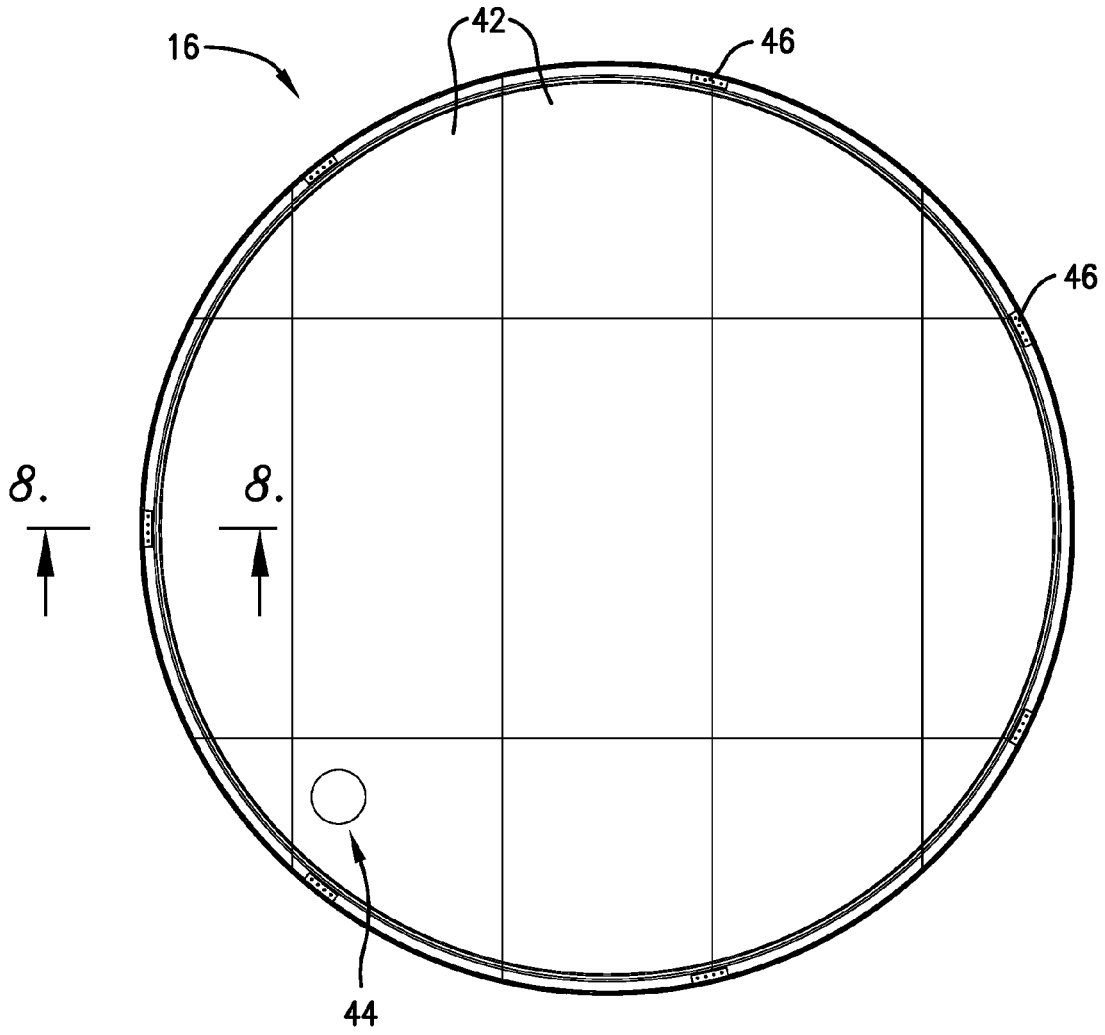
FIG. 7 is a top plan view of the tank floor of FIG. 4.
Figure 8:
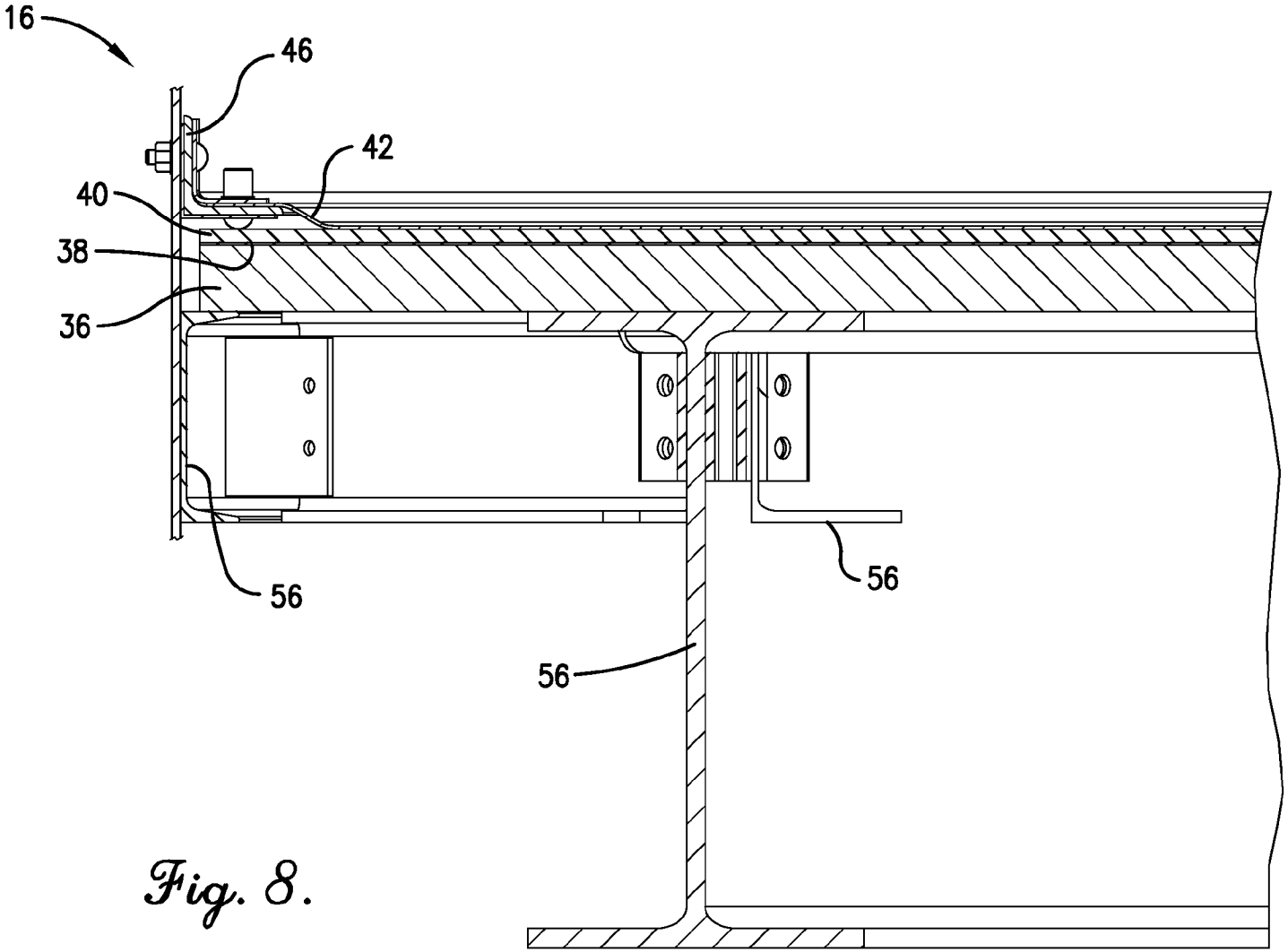
FIG. 8 is an enlarged partial elevation view of the tank floor and internal support structure of FIG. 4.

In some embodiments, the elevated tank 10 also includes a man-way door 68 and a vehicle door 70 installed or constructed in a lower portion of the outer wall 12 and an outer man-way structure 72, as best shown in FIGS. 2 and 3.

The man-way door 68 allows a worker to enter the lower chamber 52 and is installed at ground level of the outer wall 12. The man-way door 68 may be a hinged door, sliding door, or any other suitable access door.

The vehicle door 70 allows a vehicle to be driven into the lower chamber 52 and is installed at ground level of the outer wall 12. The vehicle door 70 may be a hinged door, a sliding door, a track door or flip-up door (similar to various garage door styles), or any other suitable access door.

The outer man-way structure 72 allows one or more workers to work on the outside of the elevated tank 10. The outer man-way structure 72 may be a three-hundred and sixty degree walkway located at the spring line of the tank chamber 50 (level with the tank floor 16) and may include a ladder, staircase, ramp, or similar structure, an elevated walkway, and a railing for preventing the worker from falling. The outer man-way structure 72 may be accessible via an access walkway 74 and an outer ladder 76 connecting the access walkway 74 to the outer man-way structure 72. An upper access door 78 may be positioned in the outer wall 12 below the tank floor 16 for providing access to the outer man-way structure 72 from the lower chamber 52. The upper access door 78 may in turn be accessible via an internal ladder or spiral staircase (not shown) in the lower chamber 52.

One or more additional floors similar to the tank floor 16 may be constructed above the man-way door 68 or the vehicle door 70 or below the tank floor 16 for additional storage and/or for mounting a pump station or other equipment thereon.

Construction of the elevated water tank 10 will now be described in more detail. First, panels of the first layer 26 of the outer wall 12 are bolted together and positioned over the base 24 and the ceiling 14 is bolted onto the upper edge of the first layer 26. The ceiling 14 and the first layer 26 are then jacked or lifted up via synchronized hydraulic screw jacks or other lifting mechanisms, so that another layer of panels can be constructed underneath this assembly. Panels of the second layer 28 of the outer wall 12 are then bolted together and positioned over the base 24 and under the first layer 26. The second layer 28 is then bolted to the first layer 26 at a lower edge of the first layer 26. The ceiling 14, the first layer 26, and the second layer 28 are then jacked or lifted up so that yet another layer of panels can be constructed underneath the first layer 26. Jacking or raising the previously constructed layers and constructing additional layers of panels is repeated as needed in a layer-by-layer fashion so as to form a wall assembly 80. The tank floor 16 is then assembled and placed underneath the previously constructed layers (wall assembly 80) to form the bottom of the tank chamber 50 when the desired number of outer wall layers has been constructed to achieve a predetermined height of the tank chamber 50. Panels of a bottom layer of the wall assembly 80 are bolted together around the tank floor 16 so that the tank floor 16 is enclosed in the bottom layer of the wall assembly 80. Alternatively, the tank floor 16 may be bolted to two adjacent layers. Components of the outer man-way structure 72 are also bolted or otherwise constructed outside the outer wall 12 as needed. For example, the elevated walkway of the outer man-way structure 72 may be bolted to the outer wall 12 at the same level as the tank floor 16. The ceiling 14, the wall assembly 80, the tank floor 16, and the outer man-way structure 72 are then jacked or lifted up so that additional layers of panels can be constructed underneath the assembly. For example, panels of the first lower layer 30 of the outer wall 12 are bolted together and positioned underneath the wall assembly 80. The ceiling 14, the wall assembly 80, the tank floor 16, and the first lower layer 30 of the outer wall 12 are then jacked or lifted up via synchronized hydraulic screw jacks or other lifting mechanisms, so that another layer of panels can be constructed underneath this assembly. Panels of the second lower layer 32 of the outer wall 12 are then bolted together and positioned under the first lower layer 30. The second lower layer 32 is then bolted to the first lower layer 30 at a lower edge of the first lower layer 30. The ceiling 14, the wall assembly 80, the tank floor 16, the first lower layer 30, and the second lower layer 32 of the outer wall 12 are then jacked or lifted up so that yet another layer of panels can be constructed underneath the second lower layer 32. Jacking or raising the previously constructed layers and constructing additional layers of panels is repeated as needed in a layer-by-layer fashion. This is repeated until the lower chamber 52 reaches a predetermined desired height. The internal support structure 18 is also constructed from the top down, with the vertical members 54 being bolted together beginning with the top vertical members. The vertical members 54 are also bolted to the layers of the outer wall 12 as the outer wall 12 is constructed to create the load path described above.

The layers of the outer wall 12 and the additional components of the elevated tank 10 are jacked or lifted up and additional layers of the outer wall 12 and additional components are added below the previously constructed components as described above. In this way, the elevated tank 10 is constructed primarily from the ground level. This cycle is continued until the bottom layer of the outer wall 12 is constructed and bolted to the previously constructed layer. The bottom layer of the outer wall 12 is then bolted to the base 24. The man-way door 68 and the vehicle door 70 are also installed or constructed as the bottom layers of the outer wall 12 are constructed. Additional vertical members 82 (similar to vertical members 54) may be utilized near the man-way door 68 and vehicle door 70 during installation of the man-way door 68 and vehicle door 70 for temporary support, and may be left in place after installation for additional support. Additional ground-level components of the fluid infrastructure 20 such as pumps, valves, gauges, and additional pipes (not depicted) are installed into the lower chamber 52 either before the bottom layers of the outer wall 12 are constructed, or after the outer wall 12 is completed if the components fit through the man-way door 68 or the vehicle door 70. Ladders, stairs, or ramps of the outer man-way structure 72 are also constructed as the associated panels of the outer wall 12 are constructed, as described above.

The above-described elevated tank 10 provides several advantages over conventional tanks. For example, the top-down construction of the elevated tank 10 allows the entire elevated tank 10 to be constructed without workers being required to go more than a few feet above the ground or ground surface. The elevated tank floor 16 is completely enclosed within the outer wall 12, which provides a more inconspicuous design. The tank 10 can be mass produced and shipped worldwide for assembly utilizing jacking equipment by factory trained personnel. The elevated tank 10 does not require the construction of a concrete or composite pedestal. The lower chamber 52 provides maximum space underneath the tank chamber 50 for storage and for housing the fluid infrastructure 20.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A method of constructing an elevated tank, the method comprising the steps of:

connecting together a first plurality of outer panels to form a first horizontal layer of an outer wall;

connecting a tank ceiling to the first layer such that the ceiling extends over the first layer;

elevating the first layer;

connecting together a second plurality of outer panels to form a second horizontal layer of the outer wall;

connecting together the first and second pluralities of outer panels such that the second layer of the outer wall is positioned beneath the first layer;

elevating the connected first and second layer;

connecting together a plurality of additional outer panels to form a plurality of additional layers of the outer wall, connecting each additional layer to and underneath the previously constructed layer, and elevating the first, second, and additional layers for forming more layers beneath the previously constructed layers so as to form a wall assembly;

connecting together a plurality of floor panels to form a tank floor;

connecting the tank floor to at least one layer of the wall assembly such that the tank floor is spaced at a predetermined distance beneath the ceiling and such that at least a portion of the wall assembly is higher than the tank floor, wherein the tank floor, the wall assembly, and the tank ceiling cooperatively form a tank chamber for holding a fluid or other substance;

elevating the ceiling, tank floor, and wall assembly;

connecting together a third plurality of additional panels to form a first lower horizontal layer of the outer wall;

connecting together the first lower horizontal layer to and underneath the previously constructed outer wall layer so that the first lower layer is lower than the tank floor, such that the tank floor is spaced a predetermined distance above the ground;

connecting together vertical members to form vertical columns; and connecting the vertical columns to inner sides of at least some of the outer panels so as to provide an internal support structure for absorbing bending stresses in the outer wall.

2. The method of claim 1, further comprising the step of enclosing the tank floor within the outer wall.

3. The method of claim 1, further comprising the steps of connecting together additional panels to form additional lower horizontal layers and connecting the addtional lower horizontal layers underneath a previously constructed lower horizontal layer, wherein the tank floor and the lower horizontal layers cooperatively form a lower chamber underneath the tank chamber.

4. The method of claim 3, further comprising the step of connecting a man-way door to at least some of the outer panels for forming an entry-way into the lower chamber.

5. The method of claim 3, further comprising the step of connecting a door to at least some of the outer panels for forming a vehicle entry-way into the lower chamber.

6. The method of claim 1, further comprising the step of connecting together a number of ceiling panels to form the tank ceiling.

7. The method of claim 1, further comprising the step of connecting outer reinforcements to at least some of the floor panels for absorbing bending stresses in the tank floor.

8. The method of claim 1, wherein the outer panels are rolled tapered panels.

9. The method of claim 8, wherein the outer panels are epoxy powder-coated.

10. The method of claim 1, wherein the tank floor includes an aperture for connecting a fluid infrastructure to the tank chamber.

11. A method of constructing an elevated tank, the method comprising the steps of:

connecting together a first plurality of outer panels to form a first horizontal layer of an outer wall;

connecting a tank ceiling to the first layer such that the ceiling extends over the first layer;

elevating the first layer;

connecting together a second plurality of outer panels to form a second horizontal layer of the outer wall;

connecting together the first and second pluralities of outer panels such that the second layer of the outer wall is positioned beneath the first layer;

elevating the connected first and second layer;

connecting together a plurality of additional outer panels to form a plurality of additional layers of the outer wall, connecting each additional layer to and underneath the previously constructed layer, and elevating the first, second, and additional layers for forming more layers beneath the previously constructed layers so as to form a wall assembly;

connecting together a plurality of floor panels to form a tank floor;

connecting the tank floor to at least one layer of the wall assembly such that the tank floor is concealed within the outer wall and is spaced at a predetermined distance beneath the ceiling and such that at least a portion of the wall assembly is higher than the tank floor, wherein the tank floor, the wall assembly, and the tank ceiling cooperatively form a tank chamber for holding a fluid or other substance;

elevating the ceiling, tank floor, and wall assembly;

connecting together a third plurality of additional panels to form a first lower horizontal layer of the outer wall;

connecting together the first lower horizontal layer to and underneath the previous layer so that the first lower layer is lower than the tank floor;

elevating the ceiling, wall assembly, tank floor, and first lower layer;

connecting together additional panels to form additional lower layers and connecting the additional lower layers underneath the previous lower layer such that the tank floor is spaced a predetermined distance above the ground and such that the tank floor, the lower outer wall layers, and a base cooperatively form a lower chamber underneath the tank chamber;

connecting a man-way door to outer panels of at least some of the lower outer wall layers lower for forming an entry-way into the lower chamber;

connecting together vertical members to form vertical columns; and connecting the vertical columns to inner sides of at least some of the outer panels so as to provide an internal support structure for absorbing bending stresses in the outer wall.

* * * * *